US006375139B1

(12) United States Patent
Murray et al.

(10) Patent No.: US 6,375,139 B1
(45) Date of Patent: Apr. 23, 2002

(54) ANCHORING DEVICE FOR USE IN ROCK CREVICES AND THE LIKE DURING ROCK CLIMBING ACTIVITIES

(75) Inventors: Seth Murray, 85 Benthaven Pl., Boulder, CO (US) 80303; Ryan Tucker Southern, Boulder, CO (US); Shane Stamm, Boulder, CO (US); Greg Wolos, Boulder, CO (US)

(73) Assignee: Seth Murray, Boulder, CO (US)

( * ) Notice: Subject to any disclaimer, the term of this patent is extended or adjusted under 35 U.S.C. 154(b) by 0 days.

(21) Appl. No.: 09/693,105

(22) Filed: Oct. 20, 2000

(51) Int. Cl.[7] ..... A47F 5/08; A47G 29/00
(52) U.S. Cl. ..... 248/231.9; 248/925
(58) Field of Search ..... 248/231.9, 231.91, 248/925; 294/95, 96

(56) References Cited

U.S. PATENT DOCUMENTS

| | | | | | |
|---|---|---|---|---|---|
| 3,794,369 | A | * | 2/1974 | Hnatko | 294/96 |
| 4,184,657 | A | | 1/1980 | Jardine | 248/925 |
| 4,565,342 | A | | 1/1986 | Grow | 248/925 |
| 4,575,032 | A | * | 3/1986 | Taylor | 248/925 |
| 4,586,686 | A | | 5/1986 | Cason | 248/925 |
| 4,643,377 | A | | 2/1987 | Christianson | 248/925 |
| 4,645,149 | A | | 2/1987 | Lowe | 248/925 |
| 4,712,754 | A | | 12/1987 | Brodie | 248/925 |
| 4,781,346 | A | | 11/1988 | Banner | 248/925 |
| 4,832,289 | A | | 5/1989 | Waggoner | 248/925 |
| RE33,104 | E | | 10/1989 | Taylor | 248/925 |
| 4,923,160 | A | | 5/1990 | Waggoner | 248/925 |
| 5,860,629 | A | | 1/1999 | Reed | 248/925 |
| 6,042,069 | A | * | 3/2000 | Christianson | 248/231.9 |

FOREIGN PATENT DOCUMENTS

| | | |
|---|---|---|
| WO | WO 97/10877 | 3/1997 |

OTHER PUBLICATIONS

"Long Climbing Gear 4–Cams and Bi–Cams", Climbing, Feb. 1, 2000.

* cited by examiner

*Primary Examiner*—Anita King
*Assistant Examiner*—Jon Szumny
(74) *Attorney, Agent, or Firm*—Emery L. Tracy

(57) ABSTRACT

An anchoring device for use in a rock-crevice defined by a first rock wall and an opposing second rock wall. The anchoring device comprises an axle member having a longitudinal axis. A first cam is rotatable about the longitudinal axis of the axle member and contactable with the first rock wall with the first cam having a first side wall and a second side wall. A second cam is rotatable about the longitudinal axis of the axle member and contactable with the second rock wall with the second cam having a first side wall and a second side wall. The first side wall of the first cam is aligned with the first side wall of the second cam and the second side wall of the first cam is aligned with the second side wall of the second cam. Upon a first force being applied to the first cam by the first rock wall and a second force being applied to the second cam by the second rock wall in a direction generally toward the longitudinal axis, the axle member is free from any created moment.

20 Claims, 3 Drawing Sheets

ANCHORING DEVICE FOR USE IN ROCK CREVICES AND THE LIKE DURING ROCK CLIMBING ACTIVITIES

BACKGROUND OF THE INVENTION

1. Field of the Invention

This invention relates generally to an anchoring device for use in rock crevices and the like during rock climbing activities and, more particularly, it relates to an anchoring device for use in rock crevices and the like which utilizes an overlapping dual cam supported on an axle thereby inhibiting any induced moment on the axle while supporting a climber during rock climbing activities.

2. Description of the Prior Art

When two or more climbers move over difficult or dangerous ground, it is highly advisable and common practice to utilize a rope to secure the climbers together and to anchor the rope in slidable manner to the face being climbed. Furthermore, it is prudent to obtain a firm anchor to which the rope can be suitably secured.

In the past, numerous devices have been devised to assist climbers in securing ropes to cracks or crevices in rock walls for the purpose of climbing safety. Such anchors can be natural, i.e. rock spikes, flakes, chockstones jammed in cracks, natural rock threads, and the like. With such anchors, a separate loop of rope or webbing is attached to the natural anchor and to which the climbing rope is slidably secured. As an alternative to natural anchors, artificial anchors can be utilized. Thus, artificial chockstones or nuts are known of a variety of shapes and sizes and which are inserted into cracks or holes in the face being climbed where they can be made to jam. Pitons, also known, are steel spike-like members of various shapes and sizes which can be hammered into cracks or crevices in the rock face. Yet again, it is known to provide bolts, a modified form of piton and which are designed to be hammered into drilled holes in solid rock.

So far as natural anchors are concerned, these have no inherent disadvantage so long as the rock of the face being climbed is firm and not smooth. However, at the start of a climb it is often apparent that there are an insufficient number of natural anchors existing over the whole face. Artificial chockstones provide an efficient anchor especially when placed in an uneven (ragged) crack, but placing the artificial chockstone in place tends to be somewhat difficult and/or time consuming, and even good placements can be dislodged by movement of the climbing rope. When all that is available, where an anchor is needed, is a smooth-sided, parallel-sided crack, placement of the chockstones is difficult both to make and to ensure it is secured.

Both pitons and bolts again provide extremely efficient anchors, but with pitons being made from steel they tend to be heavy and can be difficult to place. Also, removal of pitons can be extremely difficult and as they tend to scar the rock surface, many climbers are unwilling to use them. Similarly, bolts take an appreciable length of time to place and cause a permanent disfiguration of the rock face. Due to these problems, there is an unwillingness among the climbers to employ bolts, except as a last resort.

More recently, spring loaded camming devices are used incorporating multiple pivoting cams which are spring-biased toward an open position to allow placement of these devices securely into rock cracks and rock crevices of varying sizes. To position the camming devices, the climber simply pulls a trigger closing the cams until the cams fit within the rock crack or crevice. The climber then releases the trigger and the spring or springs expand forcing the cams against the rock surface. Once a load is placed on the camming device, the cams expand and secure the climber to the rock face. An induced static friction force between the camming device and the rock face counteracts the applied load. Because such devices can be subject to substantial loads in holding a falling climber, it is desirable to construct such anchors in a manner which provides the greatest possible structural integrity of the device.

Spring loaded camming devices revolutionized climbing by allowing climbers to protect parallel-sided cracks in a variety of sizes. Conventionally shaped pivoting cam devices utilizing offset cams are constructed such that if only two conventionally shaped cams were used, the reaction forces caused by the supported weight of the climber create a moment on the axle connecting the offset cams. If sufficient force is applied, the pivoting cam device will begin rotating and release its hold on the rock. Other pivoting cam devices are too large for many piton scars and rock crevices and are, therefore, either not usable in many situations or cause the climber to use only a portion of the device thereby creating an unstable, and potentially dangerous, situation.

Accordingly, there exists a need for an anchoring device for use in rock crevices and the like which sufficiently supports a climber during rock climbing activities. Additionally, a need exists for a an anchoring device for use in rock crevices and the like which inhibits the creation of an induced moment by the reaction forces from the supported weight of the climber. Furthermore, there exists a need for an anchoring device for use in rock crevices and the like during rock climbing activities which utilizes an overlapping dual cam supported on an axle thereby inhibiting any induced moment on the axle while supporting a climber during rock climbing activities.

SUMMARY

The present invention is an anchoring device for use in a rock crevice. The rock crevice is defined by a first rock wall and an opposing second rock wall. The anchoring device comprises an axle member having a longitudinal axis. A first cam is rotatable about the longitudinal axis of the axle member and contactable with the first rock wall with the first cam having a first side wall and a second side wall. A second cam is rotatable about the longitudinal axis of the axle member and contactable with the second rock wall with the second cam having a first side wall and a second side wall. The first side wall of the first cam is aligned with the first side wall of the second cam and the second side wall of the first cam is aligned with the second side wall of the second cam. Upon a first force being applied to the first cam by the first rock wall and a second force being applied to the second cam by the second rock wall in a direction generally toward the longitudinal axis, the axle member is free from any created moment.

The present invention additionally includes an anchoring system for releasably securing a climber to a rock face with the rock face having a rock crevice. The anchoring system comprises an axle member, a first cam member having a first supporting surface and a first contact surface with the first cam member rotatable about the axle member, and a second cam member having a second supporting surface and a second contact surface with the second cam member rotatable about the axle member. Upon a force being applied to the first supporting surface of the first cam member and the first supporting surface of the second cam member in a direction generally toward the axle member, the first cam member contacts the second contact surface of the second cam member and the second cam member contacts the first contact surface of the first cam member.

The present invention further includes a method for securing a climber to a rock face. The method comprises providing a first cam and a second cam, rotatably securing the first cam and the second cam to an axle member, aligning the first cam with the second cam, applying a force to the first cam and the second cam in a general direction toward the axle member, contacting the first cam with the second cam, and inhibiting any created moment on the axle member.

DETAILED DESCRIPTION OF THE PREFERRED EMBODIMENTS

Figure 1:
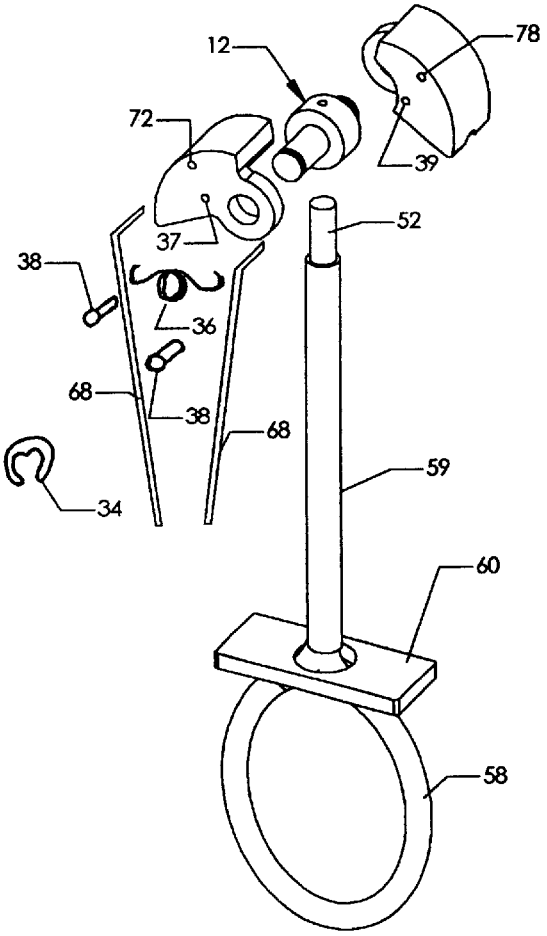
FIG. 1 is an exploded perspective view illustrating an anchoring device for use in rock crevices and the like during rock climbing activities, constructed in accordance with the present invention.
Figure 2:
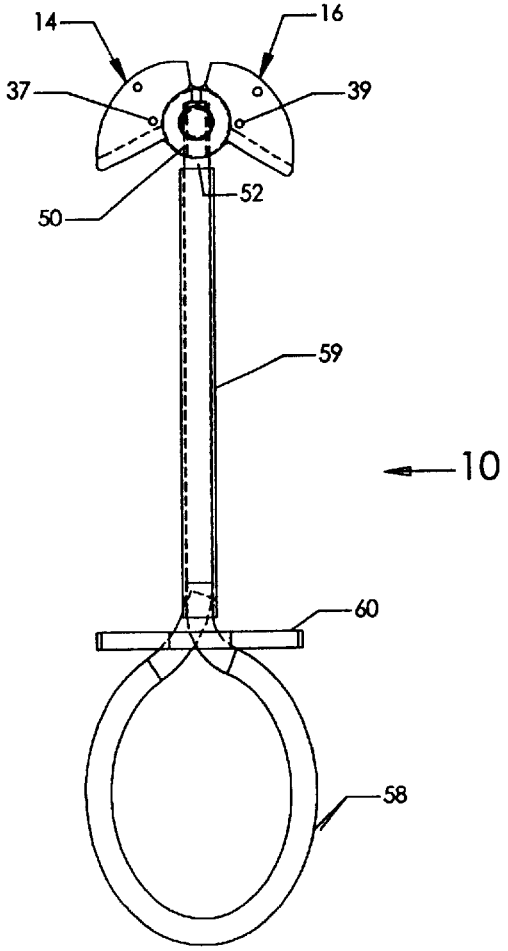
FIG. 2 is an elevational side view illustrating the anchoring device for use in rock crevices and the like during rock climbing activities of FIG. 1, constructed in accordance with the present invention.
Figure 8:
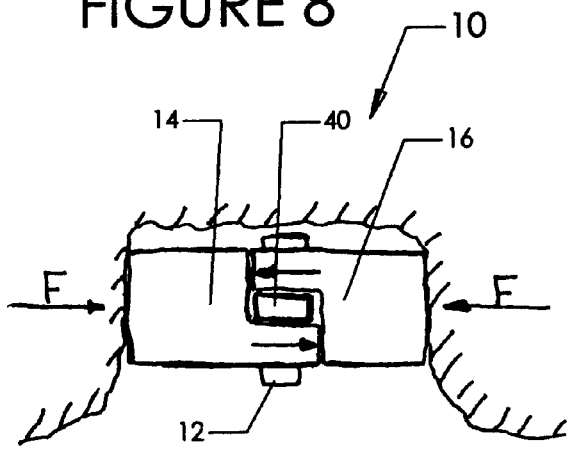
FIG. 8 is a top view illustrating the anchoring device for use in rock crevices and the like during rock climbing activities of FIG. 1, constructed in accordance with the present invention, with the anchoring device being releasably secured within the rock crevice.

As illustrated in FIGS. 1 and 2, the present invention is an anchoring device, indicated generally at 10, for use in rock crevices and the like for supporting a climber during rock climbing activities (see FIG. 8). In the present application, each element of the anchoring device 10 of the present invention will be described first.

Figure 4:
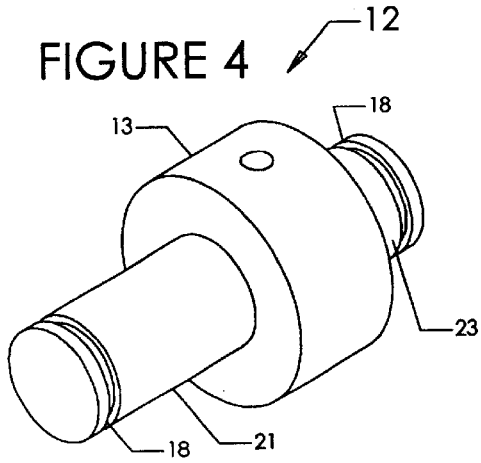
FIG. 4 is a perspective view illustrating a combined axle and shaft member of the anchoring device for use in rock crevices and the like during rock climbing activities of FIG. 1, constructed in accordance with the present invention.
Figure 5:
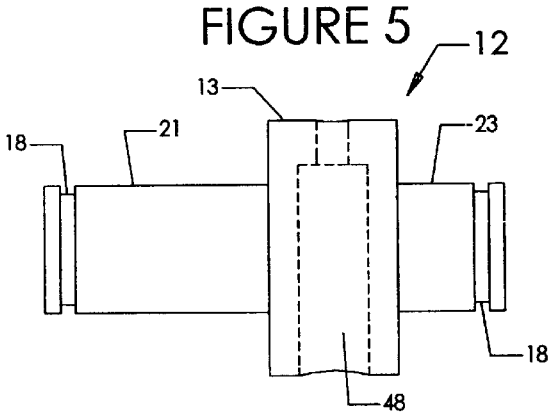
FIG. 5 an elevational side view illustrating the combined axle and shaft member of the anchoring device for use in rock crevices and the like during rock climbing activities of FIG. 4, constructed in accordance with the present invention.
Figure 6:
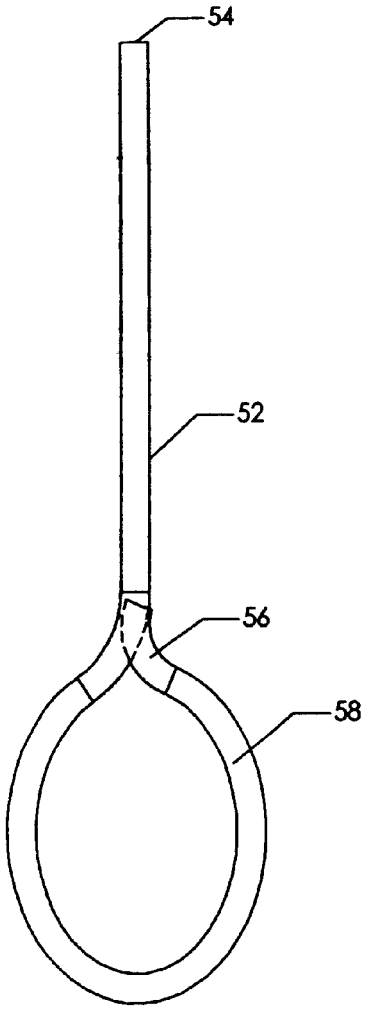
FIG. 6 is a perspective view illustrating a cable of the anchoring device for use in rock crevices and the like during rock climbing activities of FIG. 1, constructed in accordance with the present invention.
Figure 7:
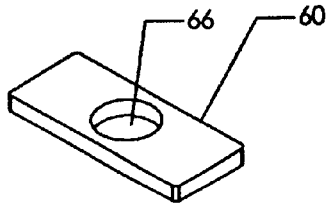
FIG. 7 is a perspective, view illustrating a trigger of the anchoring device for use in rock crevices and like during rock climbing activities of FIG. 1, constructed in accordance with the present invention.

As illustrated in FIGS. 4 and 5, the anchoring device 10 of the present invention includes a combined axle and shaft member 12 for rotatably supporting a first cam member 14 and a second cam member 16 (as illustrated in FIG. 1). Preferably, the first cam member 14 is substantially identical to the second cam member 16.

The combined axle and shaft member 12 is preferably constructed from a 17-4 PH stainless steel material. It is within the scope of the present invention, however, to construct the combined axle and shaft member 12 from a different material so long as the combined axle and shaft member 12 is capable of supporting a predetermined force, i.e., two thousand (2000 lbs.) pounds, greater than the weight of the climber or climbers.

The combined axle and shaft member 12 preferably has a length of approximately 0.87 inch and a diameter of approximately 0.25 inch. It should be noted, however, that a combined axle and shaft member 12 having a length greater than or less than 0.87 inch and a diameter greater than or less than 0.25 inch is within the scope of the present invention.

Furthermore, the combined axle and shaft member 12 of the anchoring device 10 of the present invention includes a shaft portion 13, a first axle portion 21 connected to the shaft portion 13, and a second axle portion 23 connected to the shaft portion 13 substantially opposite the first axle portion 21. Preferably, the first axle portion 21 has a length greater than the length of the second axle portion 23. Both the first axle portion 21 and the second axle portion 23 have a groove 18 having a depth of approximately 0.031 inch. Once again, it should be noted that grooves 18 having a depth of greater than and less than approximately 0.036 inch is within the scope of the present invention.

Preferably, the combined axle and shaft member 12 is constructed from a PH stainless steel material to inhibit corrosion, although constructing the combined axle and shaft member 12 from other materials including, but not limited to, other types of steel material, ceramic, plastic, etc., is within the scope of the present invention.

As illustrated in FIG. 8, and as briefly mentioned above, the anchoring device 10 of the present invention additionally includes the first cam member 14 and the second cam member 16 which redirects force and applies the force to the rock face within the rock crevice. Preferably, the first cam member 14 and the second cam member 16 are identical in size and shape and are constructed from 7075-T6 aluminum providing high strength, durability, corrosion resistance, and ease of manufacture. Other materials for constructing the first cam member 14 and the second cam member 16 are within the scope of the present invention.

Figure 3:
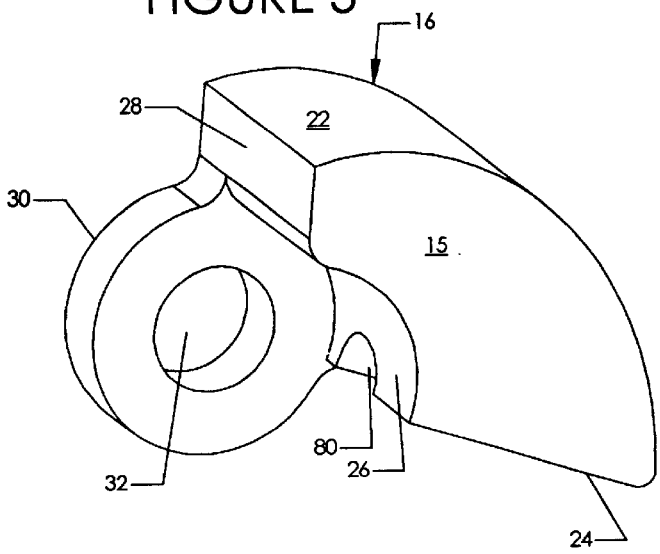
FIG. 3 is a perspective view illustrating a cam member of the anchoring device for use in rock crevices and the like during rock climbing activities of FIG. 1, constructed in accordance with the present invention.

As illustrated in FIG. 3, both the first cam member 14 and the second cam member 16 have a first side 15, a second side 17 substantially opposite the first side 15, a curved supporting surface 22 between the first side 15 and the second side 17, a substantially planar bottom surface 24, a curved bearing surface 26, and a substantially planar contact surface 28. The supporting surface 22 of each cam member 14, 16 is preferably a logarithmic spiral shape which engages the rock surfaces of the rock crevice and crack. The logarithmic spiral shape of the supporting surface 22 allows the angle between the line of force and the rock face to remain the same regardless of which portion of the supporting surface 22 is contacting the rock face. Therefore, the force diagram for the anchoring device 10 will always yield the same results.

The first cam member 14 and the second cam member 16 of the anchoring device 10 further include a flange 30 extending from the curved bearing surface 26 in a general direction substantially opposite the supporting surface 22. Each flange 30 has an axle-receiving aperture 32 formed therethrough for slidably receiving either the first axle portion 21 or the second axle portion 23 of the combined axle and shaft member 12.

As illustrated in FIGS. 1 and 2, the first cam member 14 and the second cam member 16 are positioned about the combined axle and shaft member 12 by inserting the first axle portion 21 into the axle-receiving aperture 32 of the flange 30 of the first cam member 14 and the second axle portion 23 into the axle-receiving aperture 32 of the flange 30 of the second cam member 16 such that the first side 15 of the first cam member 14 is aligned with the first side 15 of the second cam member 16, the second side 17 of the first cam member 14 is aligned with the second side 17 of the second cam member 16, and the supporting surface 22 of the first cam member 14 is facing in an opposing direction as the supporting surface 22 of the second cam member 16. At least one clip 34 or other attachment means are then positioned within each groove 18 of the combined axle and shaft member 12 for releasably maintaining the first cam member 14 and second cam member 16 in aligned rotatable fashion about the combined axle and shaft member 12.

A torsion spring 36 is mounted about the first axle portion of the combined axle and shaft member 12 and attached to the first cam member 14 and the second cam member 16 to bias the first cam member 14 and the second cam member 16 together. Preferably, a first end of the spring 36 is inserted into aperture 37 of the first cam member 14 and a second end of the spring 36 is inserted into aperture 39 of the second cam member 16 or by screws 38. The torsion spring 36 biases the first cam member 14 and the second cam member 16 in a general direction toward each other until the contact surface 28 of the first cam member 14 contacts the contact surface 28 of the second cam member 16. The torsion spring 36 maintains tension on the first cam member 14 and the second cam member 16 such that the anchoring device 10 remains stationary subsequent to placement within the rock crack or crevice. While the inventors of the anchoring device 10 of the present invention have determined that a spring 36 having a spring constant of 0.173 in-lb./rad is sufficient for maintaining the appropriate tension between the first cam member 14 and the second cam member 16, other spring constants are within the scope of the present invention depending on the size of the first cam member 14 and the second cam member 16. Actual operation of the first cam member 14 and the second cam member 16 together with the entire anchoring device 10 will be described in further detail below.

Referring now to FIG. 5, the combined axle and shaft member 12 includes an cable-receiving aperture 48 is formed in the shaft portion of the combined axle and shaft member for receiving a cable 52. The diameter of the cable-receiving aperture 48 is sized and shaped for receiving and the securing the cable 52 therein.

The anchoring device 10 of the present invention additionally includes the cable 52 having a first cable end 54 and a second cable end 56. The first cable end 54 of the cable 52 extends into the cable-receiving aperture 48 of the combined axle and shaft member 12 and secured therein. The second end 56 of the cable 52 is looped around and swaged to itself to create a loop 58. The loop 58 allows the climber to easily attach a carabiner (not shown) or the like to the anchoring device 10.

Preferably, the cable 52 is a type 304, stainless steel, 1×7 cable with a ⅛ inch diameter to support 2,100 pounds. Other types of cables 52 for use with the anchoring device 10 of the present invention are within the scope of the present invention. A sheath 59 can be positioned about the cable 52 for protecting the cable 52 from wear and damage during climbing activities.

The anchoring device 10 further still includes a trigger device 60. A cable-receiving aperture 66 is formed in the substantial center of the trigger device 60 for receiving the cable 52 and to slidably position the trigger device 60 along the cable 52. The trigger device 60 preferably has a substantially rectangular cross-sectional configuration and is constructed from an aluminum material.

A first wire 68 extends from the trigger device 60 and connects to a first wire-receiving aperture 72 in the first cam member 14. A second wire 74 extends from the trigger device 60 and connects to a second wire-receiving aperture 78 of the second cam member 16. Preferably, the first wire 70 and the second wire 76 are constructed from a stainless steel material, although other types of materials are within the scope of the present invention.

The operation of the anchor device 10 of the present invention will now be described. A person skilled in the art will understand that the anchor device 10 can be operated in numerous manners and that the description set forth below is merely one manner of operation.

As a climber climbs a rock face, the climber positions the anchoring device 10 into a rock crevice or crack formed in a rock face. First, the climber opens the first cam member 14 and the second cam member 16 by urging the trigger device 60 in a direction generally away from the first cam member 14 and the second cam member 16. The action of the trigger device 60 overcomes the bias of the torsion spring 36 and causes the bottom surface 24 of the first cam member 14 and the bottom surface 24 of the second cam member 16 to move toward each other. A cable-receiving groove 80 can be formed in the bottom surface for receiving the cable 52 when the anchoring device 10 is in the retracted position.

The first cam member 14 and the second cam member 16 are then positioned within the rock crevice or crack formed in the rock face with the spring 36 facing toward the climber. With the spring 36 being positioned about the first axle portion of the combined axle and shaft member 12, the climber can insert the anchoring device 10 further into the rock crack or crevice. The climber then releases the trigger device 60 causing the torsion spring 36 to bias the supporting surface 22 of the first cam member 14 and the supporting surface 22 of the second cam member 16 against opposed rock surfaces within the rock crevice or crack.

When a load is applied to the anchoring device 10, the reaction force on the first cam member 14 and the second cam member 16 causes the flange 30 of the first cam member 14 to contact the curved bearing surface 26 of the second cam member 16 and the flange 30 of the second cam member 16 to contact the curved bearing surface 26 of the first cam member 14. Since the first cam member 14 and the second cam member 16 rotate about the axle member 12 in the same plane, the anchoring device 10 of the present invention allows the first cam member 14 and the second cam member 16 to rotate and remain at equilibrium thereby inhibiting any induced moment on the axle member 12.

While the anchoring device 10 of the present invention has been described as having one set of cam members, namely a first cam member 14 and a second cam member 16, it is within the scope of the present invention to have multiple sets of cam members with each set of cam members including two cam members.

The anchoring device 10 of the present invention offers numerous advantages over conventional rock climbing devices. The anchoring device 10 is easily manufactured with identical first cam member 14 and second cam member 16. The anchoring device 10 is significantly narrower in width than conventional devices with the same or more camming or supporting surface 22. The anchoring device 10 can withstand the same applied force as conventional devices with the addition of the flexible cable 52 that allows the anchoring device 10 to bend over the rock, when necessary.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. An anchoring device for use in a rock crevice, the rock crevice being defined by a first rock wall and an opposing second rock wall, the anchoring device comprising:

an axle member having a longitudinal axis;

a first cam rotatable about the longitudinal axis of the axle member and contactable with the first rock wall, the first cam having a first side wall and a second side wall; and a second cam rotatable about the longitudinal axis of the axle member and contactable with the second rock wall, the second cam having a first side wall and a second side wall, the first side wall of the first cam being aligned with the first side wall of the second cam and the second side wall of the first cam being aligned with the second side wall of the second cam, the first cam being substantially identical to the second cam;

wherein upon a first force being applied to the first cam by the first rock wall and a second force being applied to the second cam by the second rock wall in a direction generally toward the longitudinal axis, the axle member being free from any created moment.

2. The anchoring device of claim 1 wherein:

the first cam has a first supporting surface contactable with the first rock wall and a first contact surface substantially opposite the first supporting surface; and the second cam has a second supporting surface contactable with the second rock wall and a second contact surface substantially opposite the second supporting surface;

wherein upon the first force being applied to the first supporting surface of the first cam in a direction generally toward the axle member and the second force being applied to the second supporting surface of the second cam in a direction generally toward the axle member, the first cam contacts the second contact surface of the second cam and the second cam contacts the first contact surface of the first cam.

3. The anchoring device of claim 2 wherein the first cam has a first flange adjacent the first contact surface and the second cam has a second flange adjacent the second contact surface, the first flange and the second flange having an aperture for receiving the axle member, the first flange contactable with the second contact surface of the second cam and the second flange contactable with the first contact surface of the first cam.

4. The anchoring device of claim 2 and further comprising:

spring means associated with the first cam and the second cam for biasing the first cam and the second cam into a closed position with the first supporting surface of the first cam and the second supporting surface of the second cam being adjacent each other.

5. The anchoring device of claim 2 and further comprising:

a trigger mechanism for moving the first supporting surface of the first cam and the second supporting surface of the second cam in a general direction away from each other.

6. The anchoring device of claim 5 and further comprising:

a first wire connected between the trigger mechanism and the first cam; and a second wire connected between the trigger mechanism and the second cam.

7. The anchoring device of claim 1 wherein the axle member includes a shaft portion.

8. The anchoring device of claim 7 and further comprising:

a cable connected to the shaft member.

9. The anchoring device of claim 8 and further comprising:

a sheath about the cable.

10. The anchoring device of claim 8 wherein the shaft portion has an aperture for receiving the cable.

11. An anchoring system for releasably securing a climber to a rock face, the rock face having a rock crevice, the anchoring system comprising:

an axle member;

a first cam member having a first supporting surface and a first contact surface, the first cam member rotatable about the axle member; and a second cam member having a second supporting surface and a second contact surface, the second cam member rotatable about the axle member;

wherein upon a force being applied to the first supporting surface of the first cam member and the second supporting surface of the second cam member in a direction generally toward the axle member, the first cam member contacts the second contact surface of the second cam member and the second cam member contacts the first contact surface of the first cam member.

12. The anchoring system of claim 11 wherein the first cam member has a first flange and the second cam member has a second flange, the first flange and the second flange having an aperture for receiving the axle member, the first flange contactable with the second contact surface of the second cam member and the second flange contactable with the first contact surface of the first cam member.

13. The anchoring system of claim 12 wherein the first flange overlaps the second flange.

14. The anchoring system of claim 11 and further comprising:

spring means associated with the first cam member and the second cam member for biasing the first supporting surface of the first cam member and the second supporting surface of the second cam member in a general direction toward each other.

15. The anchoring system of claim 11 and further comprising:

a trigger mechanism for moving the first supporting surface of the first cam and the second supporting surface of the second cam in a general direction away from each other.

16. The anchoring system of claim 11 and further comprising:

a shaft portion on the axle member between the first cam and the second cam.

17. The anchoring system of claim 11 and further comprising:

a cable connected to the shaft portion.

18. A method for securing a climber to a rock face, the method comprising:

providing a first cam and a second cam;

rotatably securing the first cam and the second cam to an axle member;

aligning the first cam with the second cam;

applying a force to the first cam and the second cam in a general direction toward the axle member;

contacting the first cam with the second cam; and inhibiting any created moment on the axle member.

19. The method of claim 18 and further comprising:

overlapping a first portion of the first cam with a second portion of the second cam;

wherein the first portion contacts the second cam and the second portion contacts the first cam.

20. The method of claim 18 and further comprising:

biasing the first cam in a direction generally toward the second cam; and moving the first cam in a direction generally away from the second cam.

* * * * *